United States Patent [19]

Williams

[11] 4,073,092

[45] Feb. 14, 1978

[54] LOST MOTION SUSPENSION SYSTEM FOR OPERABLE PARTITIONS

[75] Inventor: Charles E. Williams, Delavan, Wis.

[73] Assignee: Hough Manufacturing Corporation, Janesville, Wis.

[21] Appl. No.: 650,125

[22] Filed: Jan. 19, 1976

Related U.S. Application Data

[63] Continuation-in-part of Ser. No. 590,879, June 27, 1975, abandoned.

[51] Int. Cl.[2] ..... E05D 15/26; E05D 13/02

[52] U.S. Cl. ..... 49/127; 49/409; 160/199

[58] Field of Search ..... 49/125, 127, 130, 409, 49/410, 411; 52/64; 160/199

[56] References Cited

U.S. PATENT DOCUMENTS

| | | | |
|---|---|---|---|
| 3,696,560 | 10/1972 | Hallin | 49/409 |
| 3,783,930 | 1/1974 | Williams | 160/199 |

FOREIGN PATENT DOCUMENTS

| | | | |
|---|---|---|---|
| 903,917 | 8/1962 | United Kingdom | 49/409 |

*Primary Examiner*—Kenneth Downey
*Attorney, Agent, or Firm*—McWilliams & Mann

[57] ABSTRACT

A suspension system for operable partitions providing for several degrees of lost motion freedom, wherein the suspension system comprises an overhead track, a series of discrete panels, and a pair of carriers for each panel to suspend the respective panels individually from the track for movement of the panels between the point of use and a storage area that is remote from the space being subdivided, with each panel having a trackway along its upper end mounting a pair of trolleys that are connected one each to the respective carriers for the panel, for movement of the panel in its plane relative to the carrier supporting it. The carriers of each panel are tandem connected and by means accommodating self fitting adjustment of the individual carriers, and the carrier trolleys are resiliently connected to the panel, whereby when an individual panel is pushed edgewise in its plane, the plane shifts in its panel relative to the carriers supporting same to redistribute the weight of the panel that is supported by such carriers to take advantage of and utilize the momentum achieved, by pushing the panel to move same relative to the carriers, to assist in moving the panel carriers, through the resilient connection of the carriers to the panel, over and across track intersections and crossovers and the like. The self adjustment accommodating tandem connection of the carriers accommodates track deviations from squared and level positions and greatly eases movement of the individual panels along parallel track. The individual panels are also connected to the carriers that support same for adjustment in their respective planes to provide for squaring of adjacent panels at their edges to accommodate deviations of track from true level due to live load variations and the like.

12 Claims, 17 Drawing Figures

LOST MOTION SUSPENSION SYSTEM FOR OPERABLE PARTITIONS

This application is a continuation-in-part of my now abandoned application Ser. No. 590,879 filed June 27, 1975.

This invention relates to a suspension system for operable partitions, and more particularly to suspension systems for operable partition arrangements involving discrete panels suspended from an overhead track that are adapted to be moved along the track between the point of use and a storage area that may be remote from the space to be subdivided.

In operable partition arrangments intended for use in hotels, clubs, convention halls, and the like, for temporary subdivision of a large room space into small rooms, it is usually required that the partition system arrangement provide for movement of the panels between the point of use and a storage area that is removed from the space being subdivided. This involves an overhead track arrangement that commonly includes right angle turns, crossovers and Y intersections, and the like. Panels for installations of this type are large and heavy (being sometimes twenty to thirty feet or more in height dimension), and where the installation is for situations comparable to the hospitality market, they have to be arranged acoustically for minimum sound transmission therethrough, which adds further to the weight of the individual panels.

Panels for operable partitions of this type are usually each separately supported from the track in unhinged, discrete, relation, and by a pair of carriers located adjacent to but spaced from either side edge of the respective panels. The individual panels are moved between points of storage and points of use by being moved in their planes along the track straightaways, and around right angle or Y turns and across intersections as the track layout requires. Some installations require that as part of the storing of the panels, they be moved in a path that is perpendicular to the respective planes, that is, along parallel track.

The major difficulty encountered with partitions of this type is that they ordinarily are manually operated in moving the individual panels between the point of storage and the point of use, which usually involves the worker moving the individual panels by pushing, pulling, the otherwise manipulating same at their lower ends at a level convenient to the worker. The relatively long length of the panels means that substantial mass is involved for each panel, which makes it difficult enough to move the individual panels along track straightaways. At track crossovers and intersections, manual panel movement is particularly troublesome due to the large amount of weight supported by the individual carriers of the panel, and the fact that the configuration of the track at intersections and crossovers may result in the individual carriers dropping or socketing somewhat into them as they are traversed.

This is a particular problem with regard to the trailing carrier of the panel, as when one pushes or pulls on the panel to move it along its track, a couple acts on the panel which results in the leading carrier of the panel tending to be pushed upwardly and the trailing carrier tending to be pulled downwardly. When the panel trailing carrier has dropped or socketed into a track intersection or crossover, pushing or pulling on the panel, at the level where the individual worker can conveniently grasp the panel, can actually be self defeating to move same since the trailing carrier, by reason of the aforementioned couple, is actually being drawn downwardly by the pushing action that is intended to move it out of the intersection or crossover.

Another significant problem in connection with partitions of this type is that the individual partitions as assembled in wall forming position must be square with each other in the sense that the side edges must be in engagement from the floor to the ceiling of the space to be subdivided, to insure the effective availability of the partition acoustical rating. On installation, it is the usual practice to take considerable care to be sure that the partition track is level, but once the partition is installed, the portions of the track can easily shift from the desired level position due to such commonly encountered factors such as temperature variations, building shifts due to wind loading and settling, and live load variations on the overhead structure to which the track is applied. As experience has shown that after installation the track of such partitions can readily get out of level for reasons that are frequently not controllable, a frequent problem encountered by installers of this equipment is that partitions of the type indicated, after a period of satisfactory use, will be found to operate at well below their acoustical rating due to the failure of the individual panels to square up with adjacent panels.

A principal object of the present invention is to provide a suspension system for operable partitions in which the panel carriers are connected to the individual panels to accommodate several degrees of lost motion freedom that provide for improved overall operation of the partition.

Another principal object of the invention is to provide a suspension system for operable partitions in which the individual panels are shiftable in their planes, relative to their carriers, in such a manner as to shift the loads being carried by the individual carriers and utilize the momentum achieved by pushing or pulling the panels relative to their carriers to enable the facile movement of the panels across intersections and crossovers.

Yet another principal object of the invention is to provide a suspension system for operable partitions in which the panel is suspended from its carriers in such a manner that it is susceptible of being squared with adjacent panels.

A further important object of the invention is to provide a tandem connected carrier panel suspension arrangement for operable partitions in which the individual carriers for each panel are independently self adjustable under the camming action of the track in which they are received, insuring freedom of movement of the individual panels along parallel track as well as along the same track.

Other objects of the invention are to provide a suspension system for operable partitions that avoids criticality in leveling of the track, that accommodates live load variations, and that is economical of manufacture, convenient to install and use, and long lived in operation.

In accordance with the invention, the suspension arrangement for each panel comprises a carrier assembly that includes a pair of spaced apart carriers each provided with a roller device received in the partition track and a trolley that rides in a trackway formed along the upper end of the panel that is supported by the carriers, whereby the mass of the panel may be shifted relative to its carriers to change the weight load supported by the individual carriers for facilitating carrier traversal of intersections, crossover, and the like. The carriers of each carrier assembly are tandem connected in a manner to permit self fitting adjustment of the carriers as they ride down the overhead track, and the carriers are resiliently connected to the panel they support to provide a cushioning action for the panels. The result is that at crossovers and intersections, the individual panels may be pushed, or pulled edgewise to both shift the panel to redistribute the carrier loads involved, and apply to the tandem connected carriers of a panel, through the carrier resilient connection to the panel, a portion of the momentum achieved by the panel on being so pushed or pulled to facilitate carrier traversal of the track crossovers and intersections. Further, the self adjusting action of the individual carriers relative to each other and the panel enables the panels to be moved along parallel track as readily as along the same track.

Further in accordance with the invention, the individual panels are connected to their carriers to allow for adjustment of the panel in its plane, relative to the carriers supporting same, whereby the panels may be squared along their side edges while being assembled in wall forming position in the event that the track supporting same has gotten out of level due to such uncontrollable factors as live load variations and the like.

Still other objects, uses, and advantages will be obvious or become apparent from a consideration of the following detailed description and the application drawings, in which like reference numerals indicate like parts throughout the several views.

Figure 1:
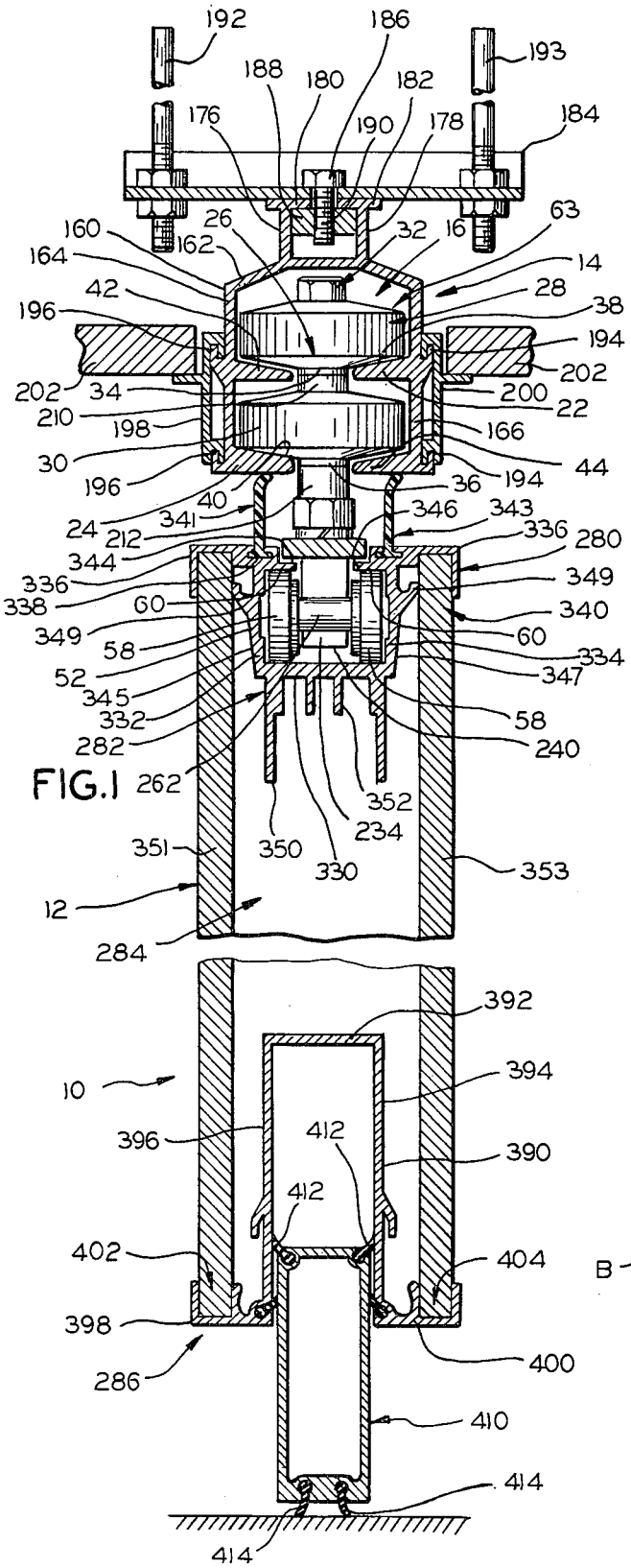
FIG. 1 is a diagrammatic vertical sectional view through a panel of an operable partition arranged in accordance with the present invention, showing also the overhead track and supporting means therefor.
Figure 2:
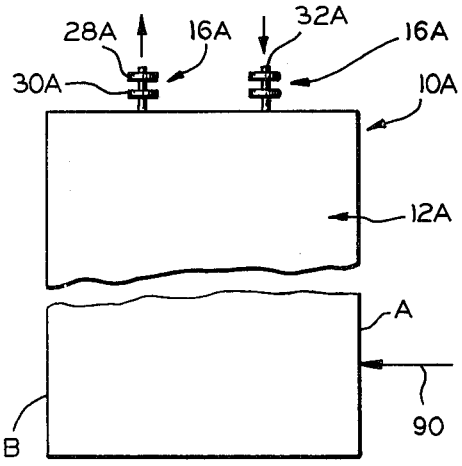
FIG.2 (PRIOR ART)
FIG. 2 is a diagram illustrating a prior art panel suspension arrangement, and presenting one of the principal problems solved by the present invention.
Figure 3:
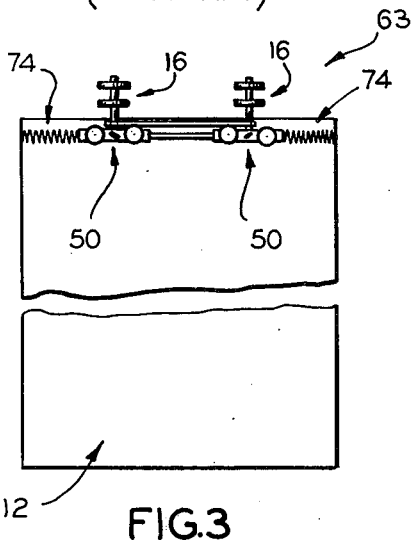
Figure 4:
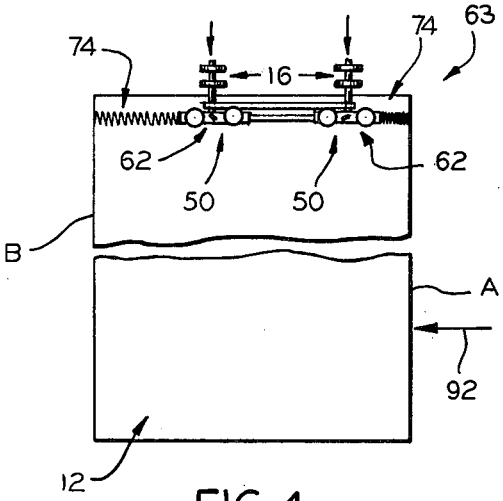
Figures 5, 5A, 5B, 6:
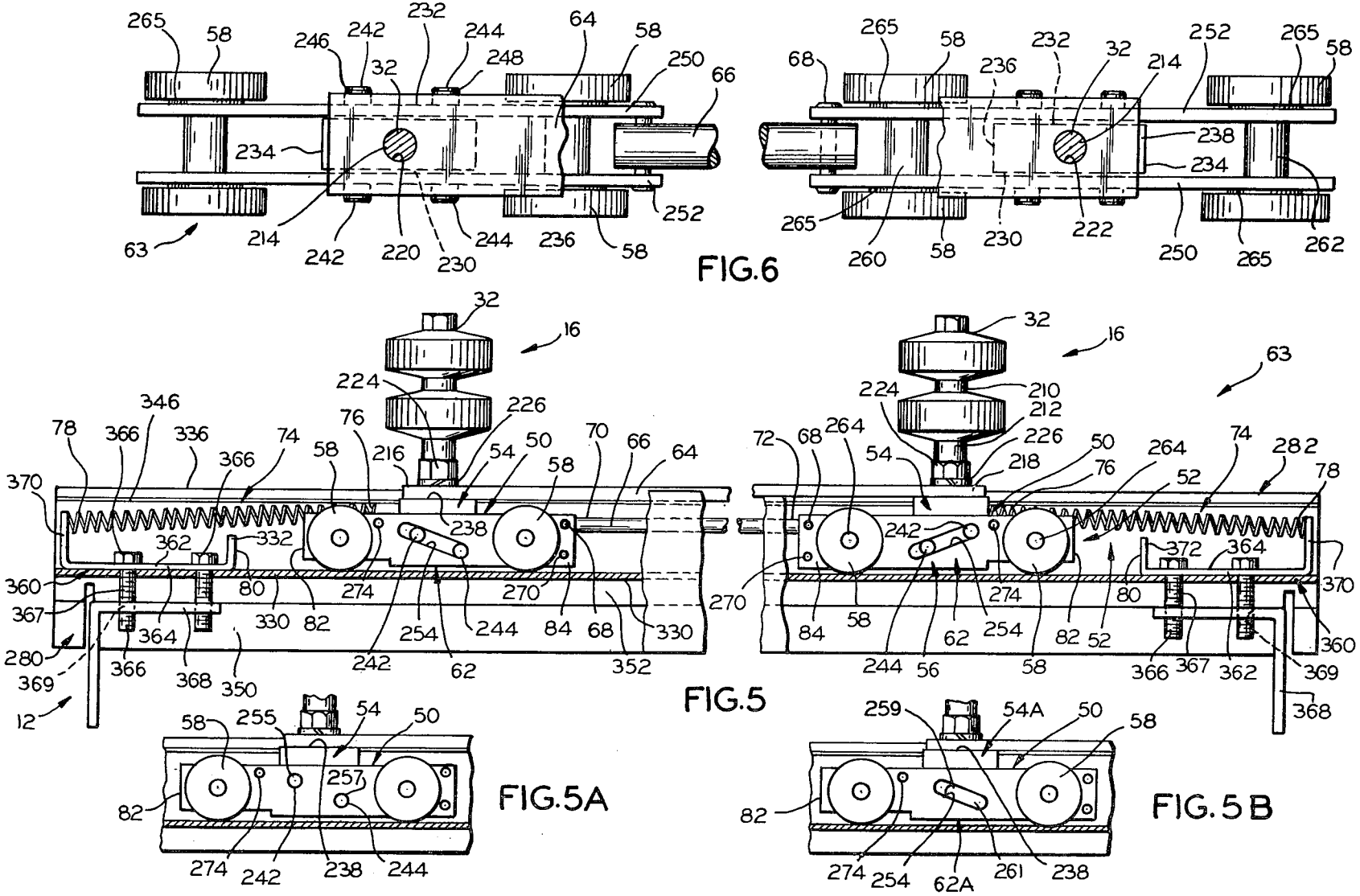
Figure 7:
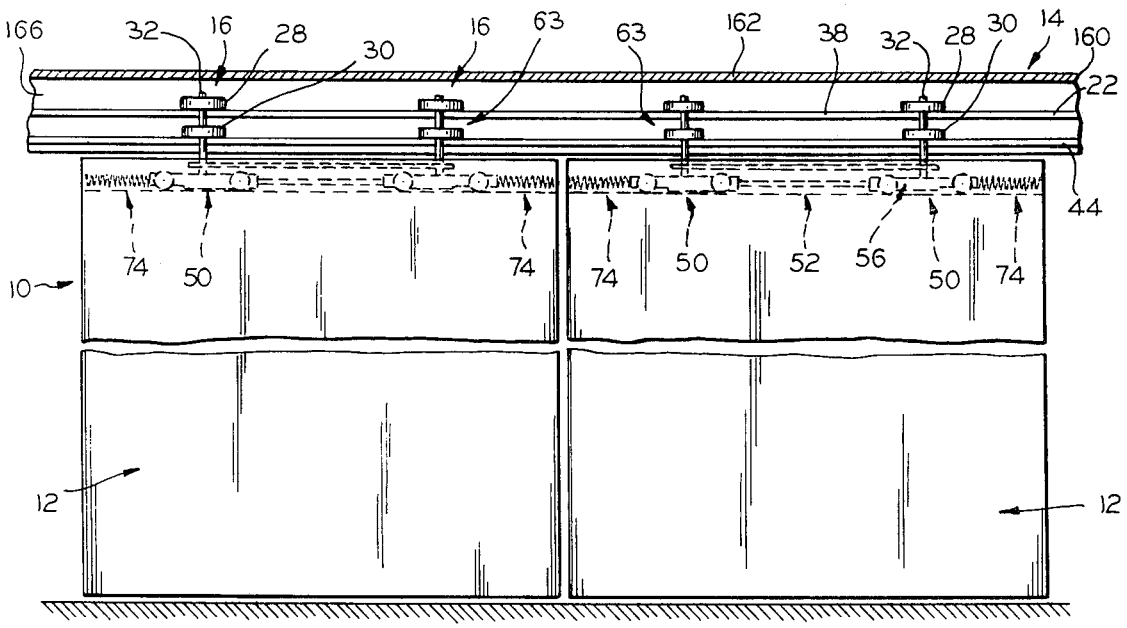
Figure 8:
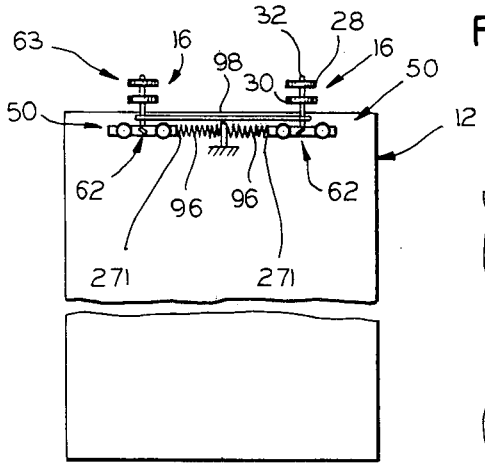
Figure 9:
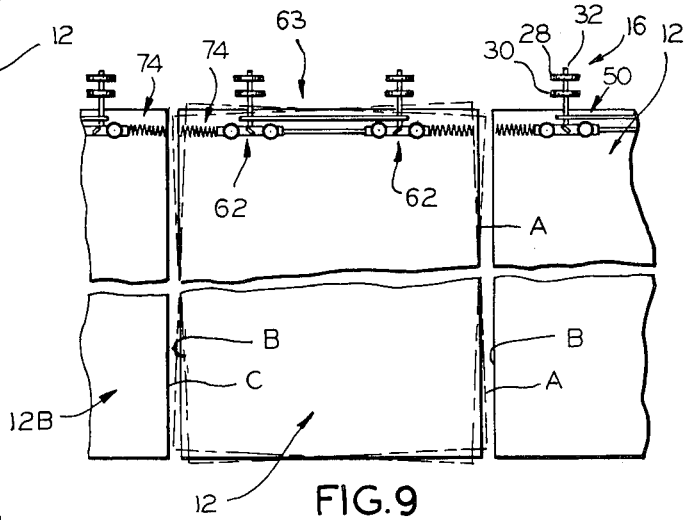
Figure 10:
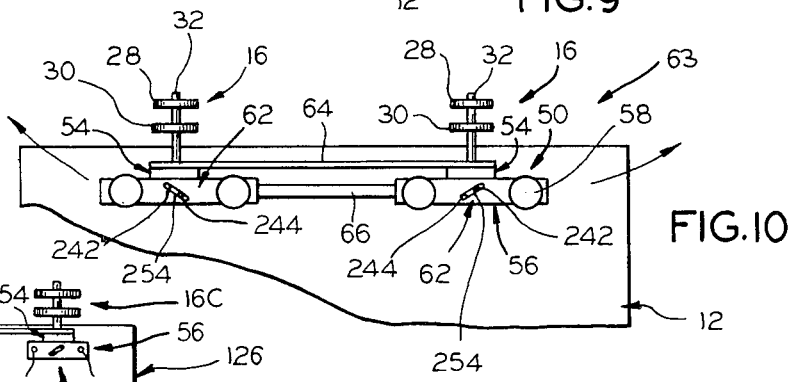
Figure 11:
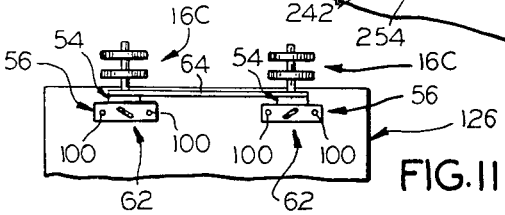
Figure 12:
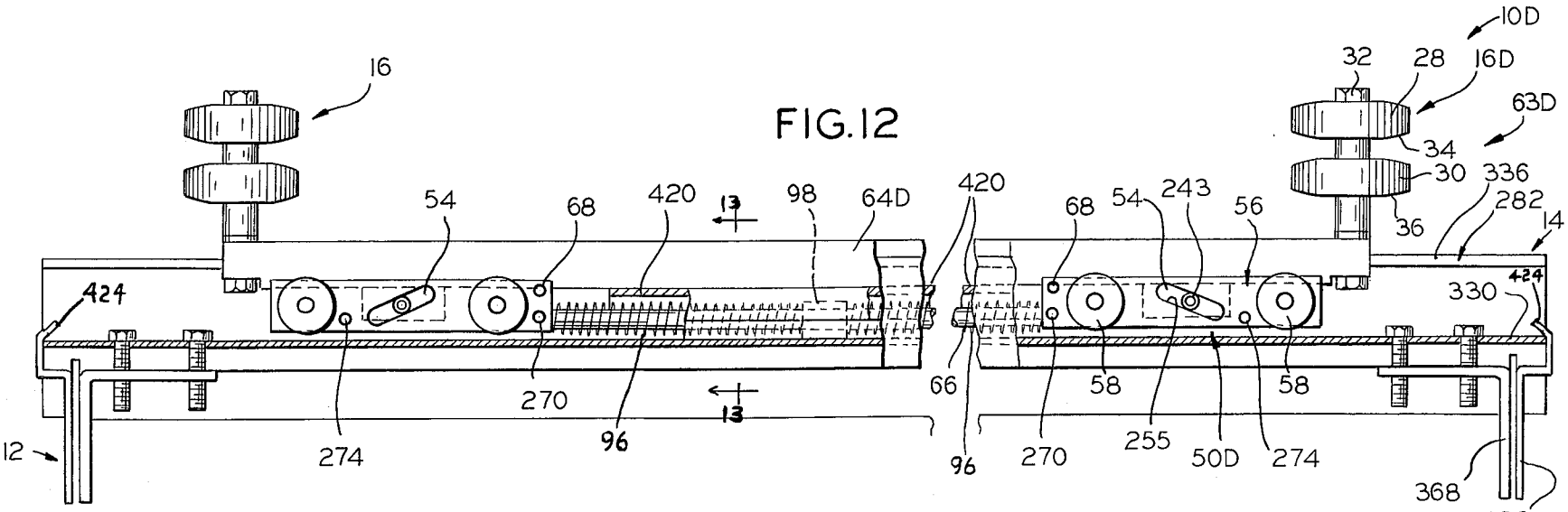
Figure 15:
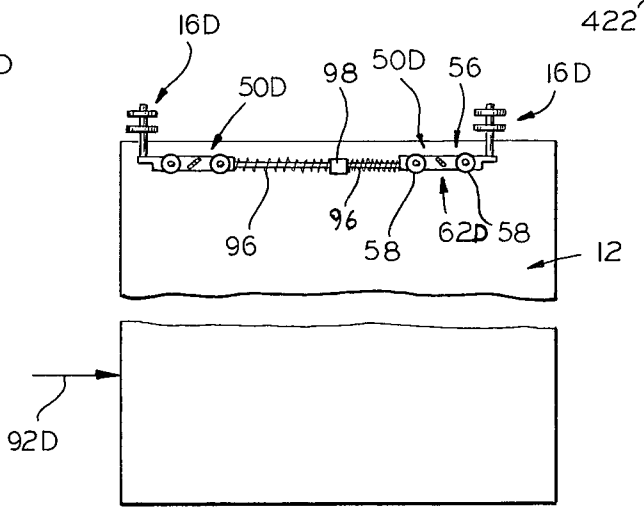
Figure 14:
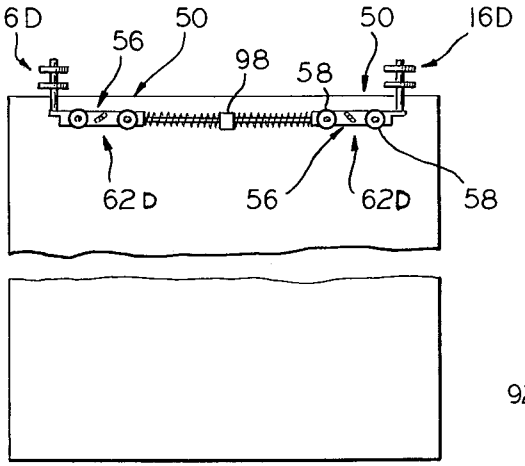
Figure 13:
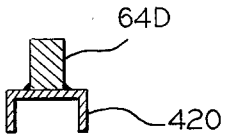

FIGS. 3 and 4 diagrammatically illustrate the present invention in a manner similar to the manner in which the prior art panel of FIG. 2 is illustrated;

FIG. 5 is a side elevational view of the upper portion of the partition panel of FIG. 1, showing the carriers and their association with the top frame member of a panel in accordance with the present invention, with parts being broken away to facilitate illustration;

FIGS. 5A and 5B are fragmental views illustrating modified forms of the invention;

FIG. 6 is a top plan view of the panel supporting carriers shown in FIG. 5, with parts being broken away or shown in section to facilitate illustration;

FIG. 7 is a diagrammatic side elevational view of an operable partition arrangement of the individual panel operated type, in which the invention of this application is involved, showing several discrete operable panels suspended in the manner contemplated by this invention, with the track being shown in vertical section, and with the panel ceiling, end edge, and floor seals being omitted to simplify the drawing;

FIG. 8 is a view similar to that of FIG. 3 but diagrammatically illustrating a modified form of the invention;

FIG. 9 is a diagrammatic view of several adjacent panels suspended in accordance with the present invention, illustrating how the individual panels may be adjusted by movement in their planes to square with adjacent panels on a track that is in an out of level condition;

FIG. 10 is a view comparable to that of FIG. 5 but on a smaller scale and largely in block diagram form, illustrating the degree of lost motion freedom that is provided by the present invention to accommodate squaring of adjacent panels when disposed in wall forming position;

FIG. 11 is a view similar to that of FIG. 10 but illustrating a modified form of the invention which provides the results illustrated by FIGS. 9 and 10;

FIG. 12 is a view similar to that of FIG. 5, but illustrating another modified form of the invention;

FIG. 13 is a fragmental sectional view substantially along line 13—13 of FIG. 12; and FIGS. 14 and 15 are views similar to those of FIGS. 3 and 4, but pertaining to the embodiment of FIG. 12.

However, it is to be distinctly understood that the specific drawing illustrations that are provided are supplied primarily to comply with the requirements of the Patent Laws, and that the invention is susceptible of other embodiments that will be obvious to those skilled in the art, and which are intended to be covered by the appended claims.

GENERAL DESCRIPTION

Reference numeral 10 of FIGS. 1 and 7 generally indicates an operable partition arrangement of the individual operated panel type, arranged in accordance with this invention which comprises a plurality of partition panels 12 each suspended from a track 14 by a pair of carriers 16 that are disposed in spaced apart relation lengthwise of the width dimension of the respective panels.

The track 14 and carriers 16 are arranged in accordance with the invention of my U.S. Pat. No. 3,879,799, granted Apr. 29, 1975, the disclosure of which is incorporated herein by this reference. The track 14 thus is formed to define on either side of same a pair of vertically spaced rollerway forming ledges 22 and 24 (see FIG. 1) which are spaced apart horizontally to define between them an operating slot 26 along which the respective carriers 16 move.

The respective carriers 16 each comprise an upper load support disc or wheel 28 and a lower load support disc of wheel 30, with the discs 28 and 30 preferably being of identical construction, and being coaxially journaled on a pendant bolt 32, which in the case of each carrier, is connected to the individual panels in the manner about to be described.

The disc 28 is formed with a lower load support side surface 34, and disc 30 is formed with a lower load support side surface 36, that respectively ride on the respective ledges 22 and 24, and specifically, the respective rollerway surfaces 38 and 40 thereof. The ledge 22 is opposed by a guidance ledge 42 while the ledge 24 is opposed by a guidance ledge 44. Ledges 42 and 44 serve no carrier support functions as the discs 28 and 30 are supported on the respective rollerway surfaces 38 and 40. However, the ledges 42 and 44 come into play at intersections and corners, as disclosed in said patent.

In accordance with the present invention, the carriers 16 for each panel 12 each include a trolley 50 that rides in a trackway 52 defined by each panel 12 adjacent its upper end (see FIGS. 1 and 5).

The trolleys 50 each comprise a body 54 to which the respective pendant bolts 32 are threadedly connected, and a wheeled frame 56 riding on wheels 58, which wheels are disposed in pairs on either side of the respective trolleys 50, and ride on rollerways 60 (see FIG. 1)

formed along the upper end of the respective panels 12 and extending the width dimension thereof.

The trolley frames 56 have a lost motion connection to the respective bodies 54, where indicated at 62. Connections 62 each provide for rectilinear lost motion movement, between the respective frames 56 and bodies 54, that for the respective panel carriers is inclined in the manner indicated in FIG. 5.

The carriers 16 of each panel are also connected in tandem relation to connect the individual carriers of a panel 12 into a carrier assembly 63, and in the form shown this is effected by connection bar 64 extending between the respective pendant bolts 36, of the carrier 16 for a particular panel 12, and a connecting rod 66 extending between the trolley frames 56 of the carriers 16 for a particular panel 12. The connection rod 66 is pivotally connected to the respective frames 66 by suitable pins 68, at the respective ends 70 and 72 of the connection rod 66. Thus, the carriers 16 and the trolley frames 56 are separately connected in tandem.

Further in accordance with the invention, the carriers 16 of each panel are resiliently connected thereto, as more specifically indicated in FIG. 5. As indicated in FIG. 5, tension springs 74 have their ends 76 suitably connected to the respective carrier frames 56, and have their other ends 78 suitably secured to the panel.

Thus, in the specific form shown in FIGS. 5 and 7, the carrier assembly 63 of each panel is interposed between the panel oppositely acting tension springs 74, and thus the carrier assembly 63 in normally centered therebetween by the bias of the springs 74 acting on the carriers 16 through the respective trolley frames 56.

In the form of FIGS. 5 and 7, each panel is provided with a pair of opposed stops 80 (see FIG. 5) which limit movement of the tandem connected carriers 16, and thus the carrier assembly 63, along the width dimension of the respective panels 12. The stops 80 are positioned to be engaged by the ends 82 of the respective trolley frames 56. The other ends 84 of the trolley frames are connected together by the connection rod 66. The stops 80 are omitted from the diagrammatic views of FIGS. 3, 4 and 7–10 to simplify illustration.

As indicated in the drawings, the individual carriers 16 are applied to the track 14 in the manner indicated in my said U.S. Pat. No. 3,879,799. The carrier pendant bolts 32 (which mount the discs 28 and 30) are respectively connected to the respective trolley bodies 54, with the trolley bodies 54 and trolley frames 56 of each carrier assembly 63 being oriented such that the lost motion connections 62 act in upwardly inclined, oppositely directed planes that diverge from each other preferably at an angle to the horizontal which lies in the range of from approximately 20° to approximately 30° (20° is preferred).

Before proceeding with description of specific details of construction, the significance of the suspension arrangement of this invention will now be described with reference to the block diagram FIGS. 2–4 and 8–11.

In the showing of FIG. 2, a prior art panel 12A is illustrated (which forms a part of the prior art operable partition 10A, of the individual operated panel type) which, for purposes of easy comparison, is assumed to have its carriers arranged and secured thereto in the manner taught by my said U.S. Pat. No. 3,879,799, which carriers are indicated at 16A. The pendant bolts 32A of the carrier 16A are thus fixed against movement relative to the panel 12A (by being fixed to the panel frame) and the discs 28A and 30A may be assumed to ride along a track comparable to a track 14 for purposes of operably suspending the respective panels 12A from the track.

As is known to those skilled in the art, panels used for equipment of the type with which this application is concerned have considerable mass due to the height of the room space they are designed to close off, which may be up to thirty or more feet in height. Panels comparable to panels 12 and 12A are moved between points of storage and points of use by the operator pushing or pulling same along one side edge as a convenience of obtaining a purchase on the respective panels for moving them. This is particularly true along track straightaways and across intersections and crossovers, although in connection with the latter, moving the panels around right angle and Y turns that may be involved will necessarily involve applying some lateral hand actuated pressure on the sides as well as the end edges of the panel.

In any event, FIG. 2 includes a force diagram illustrating how the forces applied to the panel 12A, as by pushing its side edge A as indicated by arrow 90, act on the carriers 16A (the force 90 acting on the panel 12A being normally applied at the level where the worker moving the panel 12 will grasp the panel, which may be four to six feet above floor level). Assuming the pushing force that is represented by the arrow 90 is to move the panel 12A to the left of FIG. 2, it will be seen that a couple is actually operating on the panel 12A and its carriers 16A, whereby the leading carrier 16A tends to be thrust upwardly while the trailing carrier 16A tends to be thrust downwardly. Of course, the carriers 16A of FIG. 2 are supporting the entire weight of the panel 12A and while therefore both carriers 16A will tend to remain in physical contact with the track, as the thrust indicated by the arrow 90 increases, the tendency of the leading carrier 16A to lift upwardly will increase while the tendency of the trailing carriers 16A to be thrust downwardly will also increase, in addition to the downward bias normally acting on the carriers 16A due to the weight of the panel 12A.

While this couple action on the panel is not particularly a problem along track straightaways (where the panel is moving in its plane), it becomes a marked problem where the panel 12A is to be moved across track intersections, crossovers, and the like. This is due to the fact that carriers 16A of the type indicated tend to drop slightly as they enter the intersection, and while pushing will obviously assist somewhat the leading carrier 16A in moving out of the intersection, the same pushing action will be self defeating in connection with the trailing carrier, since the pushing action involved only serves to increase the bearing action of the trailing carrier in a downward direction. Consequently, movement of panel trailing carriers of the type indicate through crossovers and intersections may require efforts to physically lift the panel at its trailing edge A as part of the maneuvering of the panel through the crossover and intersection. Pulling of the panel 12A will have the same result, though pushing is usually practiced due to the fact that panels of this type are hard to grasp for pulling purposes.

FIGS. 3 and 4 diagrammatically illustrate the arrangement shown in FIGS. 1, 5, 6 and 7 in which the carriers 16 are shown in tandem connected assemblies 63, and resiliently connected to the panel between the tension springs 74. For ease of illustration, the panel trackway 52 and stops 80 have been omitted, the showing of FIGS. 3 and 4 illustrating the arrangement of FIGS. 1 and 5–7 in block diagram form.

FIG. 3 shows the panel 12 in its at rest position, while FIG. 4 provides a showing similar to that of FIG. 2 illustrating the effect of pushing the panel 12 by applying a pushing force, indicated by the arrow 92, to its side edge A.

The result of this pushing action on the panel 12 has the effect of shifting the panel 12 to the left of FIG. 4, relative to its carrier assembly 63, since as the carrier trolleys 50 are free to move along the width dimension of the panel 12 (between the stops 80), the panel 12 when pushed as indicated will tend to shift relative to its carriers 16 within the limits dictated by the stops 80, until the inertia of or drag acting on the carrier assembly 63 is overcome, by applying to same, through the distended springs 74, the thrust that is created by reason of the distending of the springs 74 that is achieved by moving the panel 12 to the left relative to its carriers 16.

The force diagram forming a part of FIG. 4 indicates that a significant change has taken place with regard to the reaction of the carriers 16 to the application of the pushing force represented by arrow 92. Thus, as the panel 12 moves to the left with respect to its carriers 16, the weight supported by the respective carriers is changing due to the change of position of the center of gravity of the panel 12 with respect to the carriers 16, whereby the leading carrier 16 is supporting more weight of the panel 12, while the trailing carrier 16 is supporting less of the panel weight. As the thrust of the push represented by the arrow 92 diminishes, the resilient spring pressure provided by springs 74 restores the carrier assembly 63 to centered relation with respect to the panel 12.

The operation of the panel 12 that has been described is of special significance at crossovers and intersections for several reasons.

Assuming that it is the trailing carrier 16 that is at the intersection, the pushing action represented by the arrow 92 results in shifting of the mass of the panel 12 such that the leading carrier 16 may support as much as 10 percent more of the weight of the panel, resulting in a corresponding reduction of the weight of the panel supported by the trailing carrier 16. This overcomes the tendencies to form the force couple illustrated by FIG. 2, whereby the trailing carrier is actually subject to the major downward thrust, of the two carriers 16 involved. In practice it has been found that the forward shifting action of the panel due to the pushing action represented by the arrow 92 effectively overcomes tendencies to apply any substantial downward action on the trailing carrier 16.

Of course, application of the indicated pushing action to the side edge B of the panels 12A and 12 produces the effects described with reference to the respective FIGS. 2 and 4, but in opposite directions.

Another important advantage of the embodiment of the invention represented by FIGS. 3 and 4 is that at track "T" type intersections, where the panel 12 is moving down the "stem" of the "T" at right angles to the "head" of the "T", when the carriers 16 engage the portion of the track forming the head of the "T", the springs 74 provide a desirable cushioning action on the panels 12.

Another significant advantage involved in the embodiment diagrammed in FIGS. 3 and 4 is that the application of the pushing forces 92 to the panel 12 brings the individual panels up to a momentum that may be transmitted to the tandem connected carriers 16 through the leading spring 74 as it distends under the relative movement involved. Furthermore, the biasing action applied to the tandem connected carriers 16 is at the level of the carriers 16, whereby the pulling forces involved that act on the carriers 16, are applied at the level of the carriers. This is of particular utility in moving the panels through crossovers and intersections. Of course, along track straightaways, the pulling force applied to the carriers 16 is also aligned with their intended path of movement, which is even more effective in assisting their movement along the trackways.

A further improvement involved in the invention is that the tandem connection of the panel carriers 16 is of a nature that allows the individual carriers 16 (of a carrier assembly 63) to have some self centering adjustment action relative to each other, with reference to the engagement of the discs 28 and 30 in the trackway 14. This is because the connecting bar 64 and connecting rod 66 accommodate some bending and torsional flextural action thereon as may be occasioned by minor misalignments in the portions of the track 14 in which the respective carriers 16 of the particular panel are disposed. This is of particular significance where the panels 12 are moved along parallel track, in which the panels 12 will be disposed perpendicular to their path of movement. The invention of this application has been found to permit ready movement of panels 12 of the type indicated along parallel track by merely grasping one side of the panel and moving it along the parallel trackways involved, with a light but steady pushing or pulling of the panel.

In the showing of FIG. 8, the carriers 16 are assumed to be the same as shown in FIGS. 1 and 5–7, together with their tandem connections (not shown), the panel trackway 52 (not shown) and stops 80 (not shown). In this form of the invention, the carriers are resiliently connected to the respective panels 12 by compression springs 96 acting between the respective trolleys 50 and abutment 98 that is suitably mounted and fixed with respect to the panel 12.

The showing of FIGS. 9 and 10 is concerned with the panel squaring capability provided by the invention, where the lost motion connections 62 are employed.

As indicated by FIG. 10, the panel 12, in resting directly on the trolleys 50 for its support, has a degree of adjustment movement in its plane of an arcuate nature in either direction, due to the relative movement permitted between the tandem connected carrier trolleys 50 and the tandem connected carrier bodies 54 (that are fixed to the carrier bolts 32). This is in addition to the back and forth action of the panel 12 relative to its carriers 16 that is permitted by the movement of the panel 12 relative to its carriers 16 as the trolleys 50 ride along the trackway 52.

This result is of special significance in accommodating situations where a track 14 has or is likely to go out of level due to uncontrollable situations such as live load variations and the like.

While particular care is usually taken to insure the horizontal levelness of the track 14 between points of use of the panels 12 and the point of storage of same, as already indicated, there are a number of factors which may cause the track to go out of level, which will result in portions of the track straightaways becoming somewhat inclined, or bowed downward, intermediate the ends of the straightaway. Shifting and settling of the building structure involved can cause this, as well as live load variations on the ceiling structure supporting the overhead track, and the effect of temperature variations and the like on the metallic structures that ordinarily are employed to form the track 14.

For instance, it will sometimes be found that the track along straightaways varies sufficiently from a horizontally level position so that the panels 12 when disposed adjacent each other in wall forming relation will have a fanned relationship in which their end edges may be in engagement at the tops of the panels, but separated to a degree at the lower edges of the panels. This separation of the panel side edges, of course, adversely affects the acoustical results to be provided by the partition.

In accordance with the present invention, the shiftability of the respective panels 12 with respect to their carriers 16, as represented by the showing of FIG. 10, permits the individual panels 12 to the squared with adjacent panels as the panels are placed in their wall forming position.

For instance, in the showing of FIG. 9, assuming that the left hand panel is fixed against movement in its plane, the panel 12 that represents the center panel may be moved against the side edge C of the panel 12B, and by pushing on the center panel 12 of FIG. 9 at its edge A, the panel 12 may be arcuately moved in its plane, because of the lost motion connection 62, to bring its side edge B square with, and in full engagement for the length of, the side edge C of the fixed panel 12B.

The next succeeding panel 12 may be similarly maneuvered to push its side edge B against the side edge A of the center panel 12 of FIG. 9 and effect the same result. Similarly, the entire series of panels 12 along the straightaway in question may be squared to insure that the acoustical rating of the partition will be operative, whether the track arcs downwardly (as the result of a live load on the ceiling) or is otherwise off true horizontal due to conditions of the type indicated. FIG. 9 shows the middle panel 12 in two opposite dashed line positions indicating the range of movement capability of the individual panels 12, relative to their carrier assemblies 63, that is provided by lost motion connections 62.

In the embodiment of FIG. 11, the carriers 16C comprise the discs 28 and 30, their pendant bolts 32, and the trolley frames 56, but with the trolley wheels 58 omitted, and the trolley frames 56 fixed with respect to the panel 12C by employing suitable pins 100. Thus, in the embodiment 10C of FIG. 11, the carriers 16C of panel 12 are not free to float longitudinally of the trackway 52 with respect to the panel 12C, but the panel 12C is free to shift accurately in its plane, in the manner indicated in FIG. 10, to accommodate panel side separation due to track going out of level because of live load variations and the like, by reason of the lost motion connections 62.

In the embodiment 10D of FIGS. 12–15, the carriers 16D comprise the discs 28 and 30, their pendant bolts 32, trolley frames 56, and trolley bodies 54, in which the pendant bolts 32 of each carrier assembly 63D are secured to the ends of modified connecting bar 64D that has the respective trolley bodies 54 affixed to the underside of same. The resilient connection of the carrier assembly 63D to the panel 12 is by way of compression springs 96 applied over the connecting rod 66 and between the respective trolley frames 56 and tubular abutment 98 that is fixed to the panel 12 and through which rod 66 slidably extends. Lost motion connections 62D connect the bodies 54 of the respective trolleys 50D to their respective frames 56.

SPECIFIC DESCRIPTION

The trackway 14 may be arranged as described in detail in said U.S. Pat. No. 3,879,799, and while the flush mounted type application is illustrated, it will be immediately apparent that the principles of the invention are equally applicable to the suspended mount type track applications.

In the form shown, the track 14 at straightaways comprises lengths of channel shaped members 160 disposed in end to end relation and shaped to define a web portion 162 and spaced flange portions 164 and 166 that are respectively formed to define the respective ledges 22, 24, 42 and 44. The channel members 160 in the form shown also define the upwardly directed extensions 176 and 178 that define the upwardly facing abutment portions 180 and 182 against which the individual mounting channel members 184 are secured as by employing for each member 184, a bolt 186 applied to an attachment plate 188 formed with a threaded opening 190 for threadedly receiving the bolt 186. The channel members 184 are an entirely conventional support component formed with suitable openings to receive suspension bolts 192 and 193 that suspend the channel member 184 from the ceiling in an entirely conventional and well recognized manner.

The track flange portions 164 and 166 also each define on their outer sides a pair of upwardly directed projections 194 and 196 to which are applied in a conventional manner the respective trim pieces 198 and 200 that support the usual ceiling panels 202.

The track 14 may be formed from any suitable material, such as steel or aluminum, or suitable alloys of same. The crossovers and intersections employed may be in accordance with the disclosure of said U.S. Pat. No. 3,879,799.

The arrangement of the carrier discs or wheels 28 and 30 and their application to the pendant bolts 32 may also be in accordance with the disclosure of said U.S. Pat. No. 3,879,799. Accordingly, the discs 28 and 30 of each carrier are separated by an annular guidance ring 210 that is disposed between track ledges 22 and 42, and below the lower disc 30 a second annular guidance spacer ring 212 is provided on the respective bolts 32, which is disposed between the ledges 24 and 44 to provide the guidance disclosed in said U.S. Pat. No. 3,879,799.

The shanks 214 of the respective bolts 32 extend through the discs 28 an 30 and the guidance spacer rings 210 and 212 for application to the trolley bodies 54 to which they are threadedly connected.

The tie bar 64 at its ends 216 and 218 is formed with appropriate openings 220 and 222 to receive the respective bolt shanks 214 and rest against the trolley bodies 54, against which suitable nuts 224, that are threadedly mounted on the respective bolt shanks 214, are turned. Suitable lock washers 226 are shown applied between the nuts on the bars 216 in the illustrated embodiments. The bolt 32 and nut 224 of each carrier 16 are adjusted so that discs 28 and 30 and rings 210 and 212 have no movement longitudinally of the respective bolts 32.

The trolleys bodies 54 in the form shown are of parallelepiped configuration defining planar sides 230 and 232, planar ends 234 and 236, planar top 238, and planar bottom surface 240 (see FIG. 1).

Each trolley body 54 has fixedly mounted in same and projecting laterally thereof a pair of pins 242 and 244 that define projecting end portions 246 and 248 on either side of the respective trolley bodies 54.

The trolley frames 56 each comprise a pair of side frame members 250 and 252 between which the respective trolley bodies 54 are received. The side frame members 250 and 252 are both identically slotted as at 254 to receive the ends 246 and 248 of the respective trolley body pins 242 and 244 to form the lost motion connections 62. As already indicated, the pins 242 and 244, and the slots 254 have the indicated angulation relative to the horizontal in the range of from about 20 to about 30 degrees, but in opposite directions for the respective trolley bodies 54 for a particular panel 12. The slots 254 also have a length that exceeds the distance separating pins 242 and 244 an amount suitable for particular applications. For instance, for panels of eighteen foot height, the slots 254 may have an effective operating length of about one and one third inches, for a spacing of pins 242 and 244 of one inch (on centers), to provide the lost motion at connections 62 that will accommodate adequate squaring movement of the individual panels 12 to compensate for most out of level conditions encountered in practice. Additional or less lost motion may be provided at connections 62 depending on the needs of the situation to insure provision of the necessary squared relation of adjacent panels. Carrier frames 56 should be separately tandem connected for best results.

The lost motion connections 62 may be eliminated, where panel squaring is not desired or necessary, by making the trolley frames 56 fast to their bodies 54, as by forming separate holes 255 and 257 in the trolley frame members 250 and 252 (see FIG. 5A) to receive the pins 242 and 244, respectively, instead of slots 254.

The lost motion connection 62 may also be formed by employing elongated plate 259 in place of pins 242 and 244 see FIG. 5B), the plate 259 extending through trolley body 54A that has been appropriately formed to receive same, and presenting outwardly extending ends 261 on either side of same that are received in trolley frame slots 254, to form modified lost motion connection 62A.

Also applied between the trolley side members 250 and 252 are sleeves 260 and 262 through which extend the respective shafts 264 that suitably mount the trolley wheels 58 on the trolley frames 56. Washers 265 are applied between the respective wheels and frame members 252 and 254 (not shown in FIG. 1).

At the ends 84 of the respective trolley frames 56, pins 68 extend between the respective frame members 250 and 252 which connect the connecting rod 66 to the respective frames 56. Below the pin 68 may be disposed reinforcing cross pins 270 that also extend between the respective trolley frame side members 250 and 252. In the form of FIG. 8, the springs 96 may have their ends 271 suitably anchored to pins 270.

The tension springs 74 have their respective ends 76 anchored to the respective trolley frames 56 by being suitably applied to cross pins 274 extending between the side members 250 and 252 of the respective frame members 56.

The panels 12 may be constructed in a manner basically similar to that described in Holloway U.S. Pat. No. 3,450,183, and thus each panel comprises a frame 280 (see FIGS. 1 and 5) comprising a top frame member 282, spaced side frame members 284 (which are indicated only diagrammatically in FIG. 1), and a bottom frame member 286, with the top, bottom and side frame members being formed from extruded lengths of aluminum or the like.

In accordance with the invention of this application, the top frame member 282 may be arranged in the manner disclosed in Williams U.S. Pat. No. 3,783,930, and thus is in channel shaped configuration form including a base portion 330 and spaced vertically disposed side flange portions 332 and 334 each formed with an appendage or extension structure 336 shaped to define the respective recesses 340 for forming the top frame member 282 to receive the panel covers 351 and 353. The appendages or extensions 336 are also slotted as indicated at 338 to mount the respective seal elements 341 and 343 that are conventional in nature, and are shown in block diagram form.

The side surface 345 and 347 of flange portions 332 and 334 are shaped to define abutments 349 against which the panel covers 351 and 353 bear.

The top frame member 282 is further formed to define opposed projections 344 and 346 that define the respective rollerways 60 with which the wheels 58 of the trolleys 50 engage to support the respective panels 12. The projections 344 and 346 together with the web 330 and the respective flange portions 332 and 334 define the trackway 52 of the respective panels 12. The frame member 282 is formed with depending flanges 350 and 352 for reinforcing purposes.

As shown in FIG. 5, the frame member 282 at either end of same has applied thereto the respective brackets 360, each of which comprises a U-shaped plate 362 formed to define a flat base portion 364 which is secured in place against the top frame member base 330 by suitable bolts 366 having their shanks 367 threaded for application to threaded openings 369 of angle member 368 that is drawn by the bolts 366 up against the reinforcing flanges 352. The angle member 368 is employed to secure the top frame member to the side frame members in the manner indicated in said Holloway U.S. Pat. No. 3,450,185.

The brackets 360 have an upturned end 370 to which the end 78 of the respective springs 74 are suitably secured, and the other end 372 of the brackets 360 is upturned to form the respective stops 80 against which the respective ends 82 of the trolley frames 56 engage for movement limiting purposes.

The bottom frame member 286 is in the form of a channel shaped element 390 defined by a central web portion 392 and spaced vertically disposed side flange portions 394 and 396. The flange portions 396 and 394 each include a wing portion 398 and 400 respectively shaped to define the respective panel cover receiving slots 402 and 404.

The panel frame members 286 preferably operably mount a seal member 410 of the general type described in said U.S. Pat. No. 3,450,185 which moves between the extended position shown in FIG. 1 to a retracted position within the frame member 286 under the action of a suitable actuating mechanism of the general type disclosed in said U.S. Pat. No. 3,450,185 for purposes of acoustically sealing off the respective panels 12 along their bottom edges. The seal 410 is equipped with suitable sealing elements 412 that slidably engage the internal surfaces of the frame member 286, and floor engaging seal elements 414.

The frame side members 284 may be arranged as disclosed in said U.S. Pat. No. 3,450,185 (except that the panel hinging of said Pat. No. 3,450,185 is eliminated), and it will be noted that the side frame members 284 as so arranged will have seals that extend the height of the panels 12, and that are what are fully closed by the panel squaring suspension that is provided by the present invention.

In the embodiment 10D of FIGS. 12–15, the carriers 16D are displaced in the direction of the individual panel side edges to the extent that, when the panel 12 is pushed through a track crossover or intersection, the panel may be shifted forwardly sufficiently, relative to its carrier assembly 63, such that the trailing carrier 16D may be near or substantially aligned with the trailing edge of the panel, and substantially all of the weight of the panel supported by the leading carrier 16D, whereby the trailing carrier 16D may be readily drawn across the crossover or intersection by the bias applied to same by the forward compression spring 96 acting on the leading carrier 16D. This is illustrated in FIG. 15, wherein the panel 12 there illustrated is being moved to the right of the figure under an operator applied pushing action indicated by arrow 92D.

The positioning of the carriers 16D beyond the outer ends of the respective carrier frames also reduces the amount of panel side edge stick out beyond the respective carriers. This reduces the amount of clearance required, between adjacent panels, when manipulating the panels around and through turns and crossovers.

The panel squaring accommodating lost motion connections 62D involve single cross pins 243 carried by and fixed to the respective carriers bodies 54, with the trolley frame slots 255 in which the respective pins 243 are received being oppositely angled relative to the horizontal in the range of from about 20 to about 30 degrees, but with the relative angulation being opposite of that of the forms of FIGS. 3–11 (this being permitted by the disposing of the carriers 16D at the outer ends of the respective carrier frames 56).

The connection bar 64D is of rectangular transverse cross-sectional configuration with its long dimension disposed vertically (see FIG. 13). Reinforcing channel member 420 is fixed to the underside of bar 64D in overlying relation to compression springs 96. Connecting rod 66 is connected between the panel trolley frames 56 at pins 270 rather than pins 68. The arrangement involved accommodates the aforementioned lateral and torsional flexture of the carrier assembly.

Compression springs 96, in the embodiment of FIGS. 12–15 act between the respective ends 84 of the trolley frames 56 and the fixed abutment 98, which thus serve as spring seats for the respective springs 96 (to which springs 96 need not be physically connected). Abutment 98 is preferably formed from a self lubricating material, such as nylon, and is suitably fixed to frame member 282. As indicated hereinbefore, connecting rod 66 is slidably received through abutment 98.

Bracket 360 are omitted from the embodiment 10D and instead the angle members 368 are equipped with reinforcing brackets 422 having their upper ends 424 disposed to serve as movement limiting stops for carrier assemblies 63D, these parts being secured together on either side of the panel side frame member (not shown) by screws or the like (not shown).

It will therefore be seen that the invention provides a suspension arrangement for individually operated operable partitions which involves several degrees of lost motion action whereby, insofar as the individual panels 12 are concerned, the panels are shiftably mounted with respect to their carriers, which carriers are integrated into a carrier assembly of which the individual carriers have a degree of flexture with respect to each other and with respect to the panel.

Thus, for the individual panels being moved along the trackway, when crossovers and intersections are encountered, a pushing action applied to the trailing edge of the panel effects the aforementioned displacement of the panel with respect to its carriers that overcomes the tendency of the panel trailing carrier to socket into the midportion of the intersection involved, and also applies to the carrier and benefit of the panel momentum achieved by the movement of the panel with respect to its carrier, and at the level of the carriers themselves for maximum efficiency of application of such forces.

Where the panels impact against track ends at T intersections and the like, the panel itself is cushioned relative to the carriers by the resilient action of the resilient connections between the panel carrier assemblies and the panels.

The flexture that the individual carriers have with respect to each other and to the panels they support makes them self fitting within the track in which the carrier supporting discs are operably received. This is of particular benefit when the panels are moved along parallel track whereby the case of movement achieved by the practice of this invention is such that the relatively large panels involved can be readily moved along parallel track by generally pulling or pushing on one side edge of same.

The squaring capability of the individual panels relative to adjacent panels is of considerable significance in alleviating the problem of track going out of level due to live load variations and the like. The angled positioning that the individual panels can make in their planes, to either side of vertical positioning, relative to their carriers, will allow a good deal more tolerance in how level track need be and still have full benefit of a particular partition's acoustical rating.

The panel suspension system of the invention has been shown and described in association with carriers 16 of the type shown in my said U.S. Pat. No. 3,879,799 as this is the preferred embodiment. However, it will be apparent that the principles of the invention will be applicable, with considerable benefit, in utilizing suspension systems that employ as carriers trolleys or roller devices of the various known prior art types, such as those shown in Holloway U.S. Pat. No. 3,450,185, Stein U.S. Pat. No. 3,253,552, Karp et al. U.S. Pat. No. 3,708,916, and Merrill U.S. Pat. No. 3,843,995. The last three patents mentioned disclose individually operated panel type operable partition systems in which the resiliently lost motion mounted carrier assembly 63 (in which the carriers per se may be any of the types indicated) and associated parts are fully applicable. Likewise, the simplfied form of applicant's FIG. 11, providing for squaring adjustment of the panels alone, and utilizing as carriers any of the types referred to, is fully applicable to such partition systems. Therefore, the term "carrier" as used in the appended claims, is to be interpreted to mean the various types of rolling panel suspensions referred to and their equivalents, unless the contex otherwise requires.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In an operable panel type partition arrangement including a plurality of discrete panels, an overhead track defining the path of movement of the panels, and a pair of spaced apart carriers supporting each panel and riding on the track to suspend the respective panels for movement along the track, the improvement wherein:

said panels each define a trackway extending along the width dimension of same adjacent the upper end of same, said carriers of each panel each having a roller device riding on the respective panel trackways for supporting the respective panels from the track, means for tandem connecting together the carriers of the respective panels to comprise a carrier assembly for the respective panels, said carrier assemblies being discrete from each other, and means for resiliently connecting the carrier assembly of each panel to their respective panels for lost motion movement in either direction longitudinally of the respective panel trackways, said connecting means for each panel being connected between such panel and said carrier assembly thereof to resiliently oppose said lost motion movement for transmitting forward movement momentum of the individual panels on being pushed forwardly for movement in their planes along the track into forward movement of the respective panel carrier assemblies along the track, whereby manual pushing of the individual panels to move same in their planes forwardly along the track effects, through said lost motion movement, shifting of the center of gravity of the individual panels forwardly of the direction of movement for transfer to the panel leading carrier of additional weight to be supported by the panel leading carrier, and the carrier assembly thereof is biased for movement along the track in the direction of such panel movement, through said connecting means.

2. The improvement set forth in claim 1 wherein:

said tandem connecting means for the respective carrier assemblies is torsionally flexible.

3. The improvement set forth in claim 2 wherein:

said carriers of each carrier assembly each include a trolley riding on the panel trackway and comprising said roller device thereof, said tandem connecting means for each carrier assembly comprising:

a tie rod extending between and connecting the carrier assembly trolleys, and a tie bar connecting the carriers of the respective carrier assemblies independently of said trolleys thereof.

4. The improvement set forth in claim 1 wherein:

said carriers each comprise a vertical support member depending from and supported by the roller device thereof, said carrier assemblies carrying a mounting body for each support member thereof, and with said mounting bodies of the respective support members being connected to the panel for limited free lost motion rocking action of the panel in its plane relative to its said support members under manual pushing on the panel against a side edge of same in the panel plane and adjacent the lower end of same, whereby the side edges of adjacent panels may be placed in squared contacting relation while accommodating deviations from horizontal level of the track by manual handling of the panels adjacent the lower ends of same.

5. The improvement set forth in claim 4 wherein the connection of said mounting bodies to the respective panels comprises:

lug and slot interfitting means, with the lug and slot interfitting means for each panel at the respective support members acting at oppositely and upwardly directed substantially equal angles in the range of from approximately 20 degrees to approximately 30 degrees in diverging directions.

6. The improvement set forth in claim 4 wherein the connection of said bodies to the respective panels comprises:

pin and slot interfitting means, with the pin and slot interfitting means for each panel at the respective support members acting in oppositely and downwardly substantially equal angles in the range of from approximately 20° to approximately 30+ in converging directions.

7. The improvement set forth in claim 1 wherein:

said tandem connecting means for each panel comprising:

a tie rod extending between the panel roller devices, and a tie bar connecting the panel carriers independently of said roller devices, a fixed stop adjacent the respective side edges of the panel for limiting the movement of the panel roller devices relative to the panel trackway, said roller devices of each panel being connected to their respective carriers for limited free lost motion rocking action of the panel in its plane relative to its carriers under manual pushing of the panel against a side edge of same in the panel plane and adjacent the lower end of same, whereby the side edges of adjacent panels may be placed in squared contacting relation while accommodating deviations from horizontal level of the track by manual handling of the panels adjacent the lower ends of same.

8. In a manually operated operable panel type top supported partition arrangement for temporarily subdividing room space including a plurality of discrete panels, an overhead track system from which said panels are suspended for movement between a storge position and selected wall forming positions within the room space, with the respective panesl each being suspended from the track system by a pair of carriers supporting the respective panels, and with the track system defining one or more right angle turns and intersections over which the carriers of at least some of the respective panels are to move when being moved between said positions, the improvement wherein:

said panels each define a trackway extending along the width dimension of same adjacent the upper end of same, said carriers of each panel each having a roller device riding on the respective panel trackways for supporting the respective panels from the track system, said carriers of the respective panels being connected in tandem to comprise a carrier assembly for the respective panels, and means for resiliently connecting said carrier assemblies of each panel to their respective panels for lost motion movement in either direction longitudinally of said panel trackway, said connecting means for each panel being connected between such panel and said carrier assembly thereof to resiliently oppose said lost motion movement for transmitting forward movement momentum of the individual panels on being pushed forwardly for movement in their planes along the track system into forward movement of the respective panel carrier assemblies along the track system, whereby manual pushing of the individual panels to move same in their planes forwardly along the track system effects, through said lost motion movement, shifting of the center of gravity of the individual panels forwardly of the direction of movement for transfer to the panel leading carrier of additional weight to be supported by the panel leading carrier, and the carrier assembly thereof is biased for movement along the track system forwardly of the direction of such panel movement, through said connecting means.

9. The improvement set forth in claim 8 wherein:

the tandem connection of the carriers of the carrier assembly for each panel includes means for accommodating limited sidewise tilting of such carriers relative to each other for ease of movement of such carriers when separately operating along parallel portions of said track system.

10. The improvement set forth in claim 8 wherein:

said connecting means of each panel is oriented relative to the carrier assembly thereof to act on such carrier assembly, in inducing said forward movement of same, at the level of such carrier assembly and in substantial parallelism with the path of movement of same along the track system.

11. In a panel unit for an operable panel type partition arrangement including an overhead track defining the path of movement of the panel unit over the partition support surface between points of storage and use, with the panel unit including a panel and a pair of carriers for each panel unit riding on the track for mounting the panel unit on the track for movement of the panel unit along the track, the improvement wherein:

said panel defines a trackway extending along the width dimension of same adjacent the upper end of same, said carriers each having a roller device riding on the panel trackway for supporting the panel from the track, said carriers being connected in tandem to comprise a carrier assembly for the panel, and means for resilently connecting said carrier assembly to the panel for lost motion movement in either direction longitudinally of said panel trackway, said connecting means for the panel being connected between the panel and said carrier assembly thereof to resiliently oppose said lost motion movement for transmitting forward movement momentum of the panel on being pushed forwardly for movement in its plane along the track into forward movement of the panel carrier assembly along the track, whereby manual pushing of the panel to move same in its plane forwardly along the track effects, through said lost motion movement, shifting of the center of gravity of the panel forwardly of the direction of movement for transfer to the panel leading carrier of additional weight to be supported by the panel leading carrier, and the carrier assembly thereof is biased for movement along the track forwardly of the direction of such panel movement, through said connecting means.

12. The improvement set forth in claim 11 wherein:

said carriers each comprise a vertical support member depending from and supported by the roller device thereof, said carrier assembly carrying a mounting body for each support member thereof, and with said mounting bodies of the respective support members being connected to said panel for limited free lost motion rocking action of the panel in its plane relative to its said support members under manual pushing of the panel against a side edge of same in panel plane and adjacent the lower end of same, whereby a side edge of the panel may be placed in squared contacting relation with the side edge of an adjacent panel while accommodating deviations from horizontal level of the track by manual handling of said panel adjacent the lower end of same.

* * * * *

UNITED STATES PATENT OFFICE

CERTIFICATE OF CORRECTION

Patent No. 4,073,092 Dated February 14, 1978

Inventor(s) CHARLES E. WILLIAMS

It is certified that error appears in the above-identified patent and that said Letters Patent are hereby corrected as shown below:

Column 14, line 61, "contex" should read --context--;

Column 16, line 25, "30+" should be --30°--; Column 16, line 52, "panesl" should read --panels--;

Signed and Sealed this

*Twenty-fifth* Day of *July 1978*

[SEAL]

*Attest:*

RUTH C. MASON
*Attesting Officer*

DONALD W. BANNER
*Commissioner of Patents and Trademarks*